United States Patent [19]

Taylor et al.

[11] 4,352,871

[45] Oct. 5, 1982

[54] POLYMERIC HYDROXAMIC ACID POLYVALENT METAL SALT INTERLAYER FOR PHOTOGRAPHIC DIFFUSION TRANSFER PRODUCTS

[75] Inventors: Lloyd D. Taylor, Lexington; William C. Schwarzel, Billerica, both of Mass.

[73] Assignee: Polaroid Corporation, Cambridge, Mass.

[21] Appl. No.: 217,548

[22] Filed: Dec. 17, 1980

[51] Int. Cl.[3] ..... G03C 5/54; G03C 1/42

[52] U.S. Cl. ..... 430/505; 430/215; 430/502

[58] Field of Search ..... 430/214, 215, 236, 502, 430/503, 505

[56] References Cited

U.S. PATENT DOCUMENTS

| | | | |
|---|---|---|---|
| 3,384,483 | 5/1968 | Becker | 96/29 |
| 3,421,892 | 1/1969 | Taylor | 96/3 |
| 3,477,849 | 11/1969 | Becker | 96/29 |

*Primary Examiner*—John E. Kittle
*Assistant Examiner*—John L. Goodrow
*Attorney, Agent, or Firm*—Louis G. Xiarhos

[57] ABSTRACT

Photosensitive elements for color diffusion transfer film units comprising a support layer, at least two selectively-sensitized silver halide layers having image-dye forming materials associated therewith, and a novel interlayer, separating the silver halide layers, comprising a polymeric hydroxamic acid polyvalent metal salt which serves as a barrier to the migration of solubilized image-dye forming material until it is rendered permeable to the image-dye forming material subsequent to contact with a sequestering agent for the polyvalent metal of the salt barrier.

20 Claims, 1 Drawing Figure

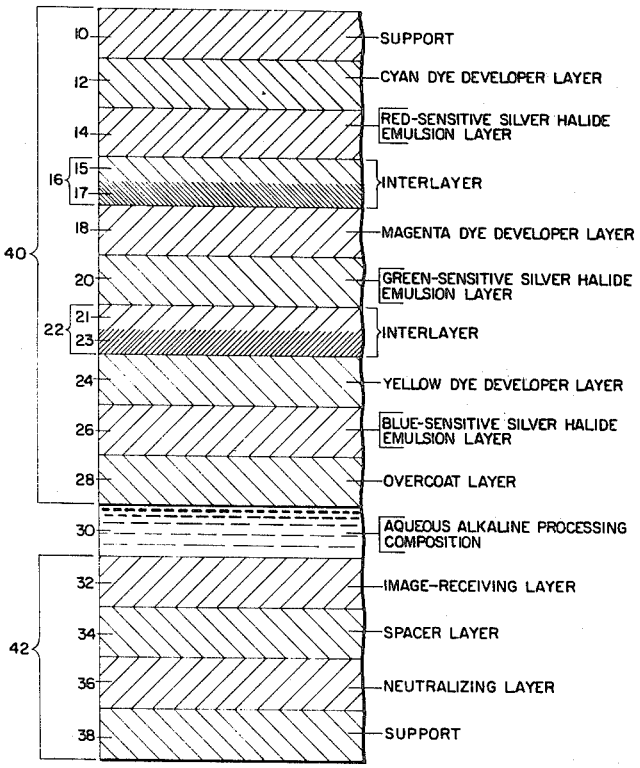

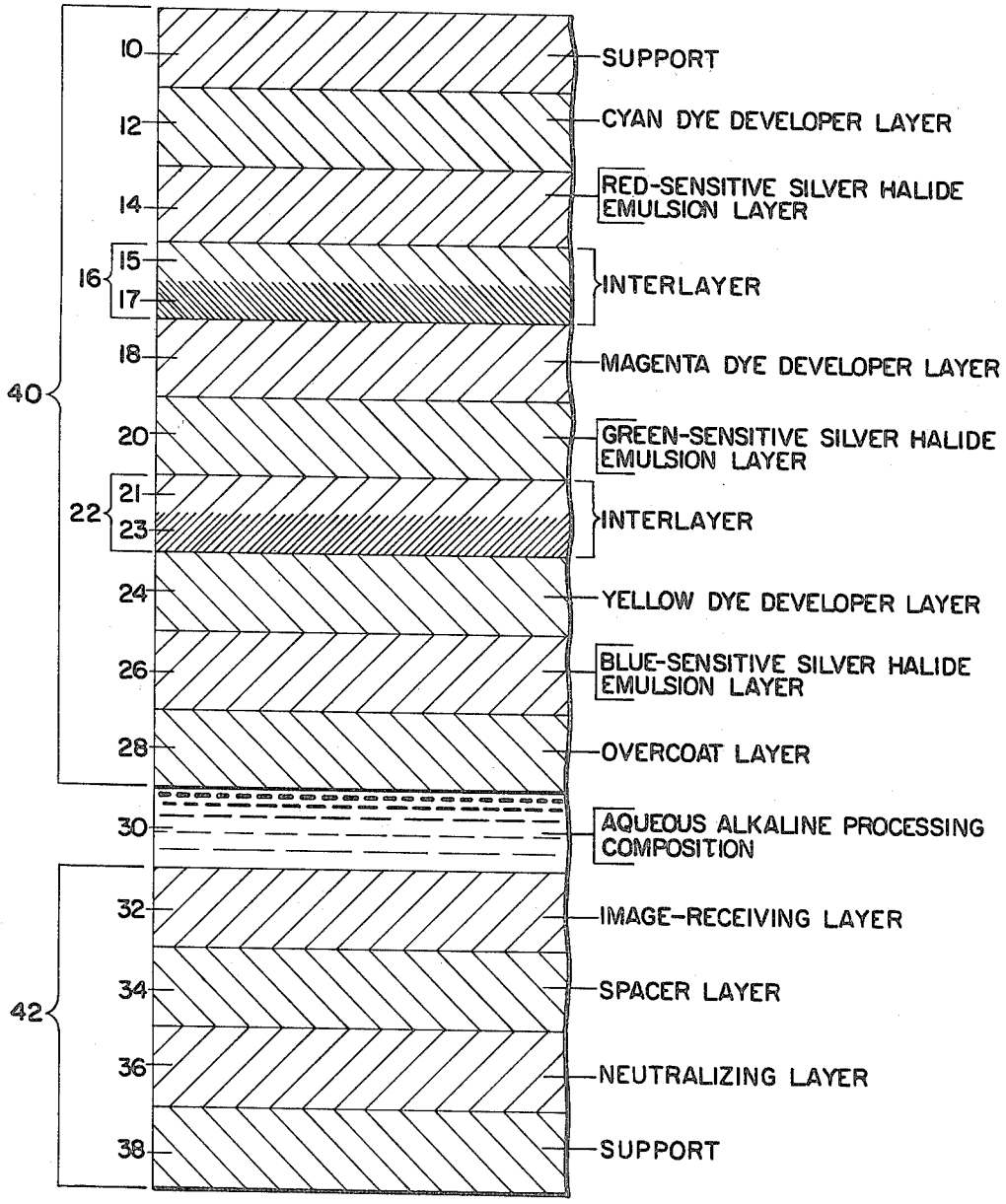
10
SUPPORT
12
CYAN DYE DEVELOPER LAYER
14
RED-SENSITIVE SILVER HALIDE EMULSION LAYER
16
15
17
INTERLAYER
18
MAGENTA DYE DEVELOPER LAYER
40
20
GREEN-SENSITIVE SILVER HALIDE EMULSION LAYER
22
21
23
INTERLAYER
24
YELLOW DYE DEVELOPER LAYER
26
BLUE-SENSITIVE SILVER HALIDE EMULSION LAYER
28
OVERCOAT LAYER
30
AQUEOUS ALKALINE PROCESSING COMPOSITION
32
IMAGE-RECEIVING LAYER
42
34
SPACER LAYER
36
NEUTRALIZING LAYER
38
SUPPORT

POLYMERIC HYDROXAMIC ACID POLYVALENT METAL SALT INTERLAYER FOR PHOTOGRAPHIC DIFFUSION TRANSFER PRODUCTS

Diffusion transfer photographic processes are well known in the art. Such processes have in common the feature that the final image is a function of the formation of an imagewise distribution of an image-providing material and the diffusion transfer of said distribution to an image-receiving layer. In general, a diffusion transfer image is obtained first by exposing to actinic radiation a photosensitive element, or negative film component, which comprises at least one light-sensitive silver halide layer, to form a developable image. Thereafter, this image is developed by applying an aqueous alkaline processing fluid to form an imagewise distribution of soluble and diffusible image-dye providing material, and transferring this imagewise distribution by diffusion to a superposed image-receiving layer, or positive film component, to impart a transfer image thereto.

The negative and positive components of a diffusion transfer photographic system may be separate elements which are brought together during processing and thereafter either retained together as the final print or separated following image formation; or, they may together comprise a unitary structure, an integral film unit wherein the negative and positive components are physically retained together prior to exposure and following image formation.

The image-dye providing materials which may be employed in diffusion transfer photographic processes generally may be characterized as initially soluble or diffusible in the processing composition but selectively rendered nondiffusible in an imagewise pattern as a function of development, or as initially insoluble or nondiffusible in the processing composition but selectively rendered diffusible in an imagewise pattern as a function of development. These materials may contain complete dyes or dye intermediates, e.g., color couplers.

A particularly useful class of image-dye providing materials for diffusion transfer processes are dye developers. These compounds contain, in the same molecule, both the chromophoric system of a dye and also a group adapted to develop exposed photographic silver halide. Although the principles presented are readily adaptable to other diffusion transfer processes, in order to simplify the presentation herein, the preferred diffusion transfer photographic process utilizing dye developer image-dye providing materials has been selected to be discussed in more specific detail below.

Multicolor images in a diffusion transfer system can be obtained by arranging a photosensitive element with at least two silver halide layers selectively sensitized to different regions of the spectrum. Such a system is shown, for example, in U.S. Pat. No. 2,983,606. To accomplish subtractive color photography, associated with each silver halide layer is a dye developer compound featuring an absorption that is substantially complementary in color to the color of the light recorded in the contiguous silver halide layer. The most commonly employed arrangement of this type includes three monochrome units—a blue-sensitive silver halide layer overlying a yellow dye developer, a green-sensitive silver halide layer overlying a magenta dye developer and a red-sensitive silver halide layer overlying a cyan dye developer.

Such an exposed photosensitive element is processed using an aqueous alkaline processing composition containing an alkali, such as potassium hydroxide. The processing composition penetrates the layers of the negative element and dissolves the the dye developer compounds by ionizing the developer groups. Once solubilized, the dye developers are capable of moving from their original positions to develop the latent image on the silver halide layers. In each silver halide layer, where the silver halide has been fully exposed, it is reduced by the dye developer which becomes insoluble or at least substantially immobile. In unexposed regions of silver halide, the solubilized dye developer passes through the overlying layers and on through into an image-receiving layer to form a positive multicolor image.

Ideally, each dye developer should develop only its own contiguous, associated silver halide layer to which it is complementary. Specifically, the yellow dye developer should develop only the blue-sensitive silver halide; the magenta dye developer should develop only the green-sensitive silver halide; and the cyan dye developer should develop only the red-sensitive silver halide. In an actual system, however, while each dye developer will primarily develop its contiguous, complementary silver halide layer, the dye developers also have a tendency to stray and develop other nonassociated silver halide layers as well. If dye developer is free to migrate throughout the structure to other silver halide layers before each exposed silver halide layer has been fully developed by its respective associated dye developer, the resulting undesirable color contamination will produce transfer images having reduced color intensity and quality.

In order to remedy this interference, a wide variety of materials, offering varying degrees of effectiveness, has been suggested as interlayers positioned between the silver halide layers to separate them from contiguous, nonassociated dye developer compounds. These interlayer materials are generally designed to prevent premature migration of a dye developer to a nonassociated silver halide layer before that silver halide layer has been fully developed by its own associated dye developer. Ideally, such interlayers should function to allow immediate unrestricted passage of processing composition alkali to initiate development of each of the silver halide layers by its respective dye developer. For a brief, predetermined initial period, however, the interlayer should be impermeable to the alkali-solubilized dye developer materials, so that each exposed silver halide layer will be developed by its respective complementary dye developer compound before a dye developer associated with another silver halide will be able to permeate the interlayer barrier and interfere with an unrelated development process. Following this initial, brief, predetermined period, after which all silver halide development processes should be completed, the interlayer should abruptly release. Interlayer release permits unrestricted passage of all the dye developers. which then are free to migrate through each of the silver halide layers en route to capture by a mordant in the image-receiving layer, where they will form a positive multicolor image.

Now, according to the present invention, a photosensitive element is provided which comprises a support layer, at least two selectively sensitized silver halide layers having image-dye forming materials associated therewith, and a novel interlayer separating the silver halide layers comprising an alkali processing composition permeable polymeric hydroxamic acid polyvalent metal salt which serves as a barrier to migration of alkali-solubilized image-dye forming material. This barrier is rendered permeable to said alkali-solubilized image-dye forming material subsequent to contact of the interlayer with an organic alkali-soluble sequestering agent for the polyvalent metal of the polymeric hydroxamic acid salt.

The subject interlayer comprises a polymeric hydroxamic acid polyvalent metal salt barrier layer which is alkali permeable and, accordingly, permits alkali from the processing composition to readily penetrate the layers of the exposed photosensitive negative structure. This interlayer is, however, selectively permeable to alkali, and at the same time, serves as a barrier to the alkali-solubilized dye developer compounds. In this manner, the dye developers are initially restricted to development activity only with their own associated silver halide layers.

In accordance with the present invention, the development process is conducted in the presence of an organic, alkali-soluble sequestering agent. This agent chelates the polyvalent metal ion of the polymeric hydroxamic acid salt layer and forms a complex. The resulting polymeric hydroxamate, formed by removal of the polyvalent metal, is a water-soluble polymer. Hence, through action of the sequestering agent, the interlayer is rendered permeable to the solubilized dye developer compounds and they are free to migrate through the multi-layer negative structure to a superposed image-receiving layer.

The sequestering agent used in the development process is solubilized by the alkali processing composition and then proceeds to react and chelate the polyvalent metal ions from the salt barrier of the interlayer. The reaction time involved in chelation provides an adequate time delay for each respective silver halide layer to be developed by its associated dye developer compound before the interlayer barrier is rendered permeable to the dye developers.

Any suitable hydroxamic acid-containing polymeric or copolymeric composition can be employed in preparing the interlayer of the present invention. The composition must be alkali-permeable, water soluble and capable of forming a uniform film. In general, the composition should contain polymeric hydroxamic acid in a proportion ranging from about 50 to about 100 mole percent of total polymer; about 80 to 90 percent is preferred. Polyvinyl hydroxamic acids have been found to provide favorable results. Suitable copolymeric compositions may include, for example, polymeric hydroxamic acid grafted onto a cellulose polymer, or, copolymers with other vinyl monomers. In specific, favorable copolymers have been found to include poly(acrylic acid) and poly(methyl acrylate). Suitable polyvinyl hydroxamic acid polymers include:

poly(acrylhydroxamic acid); poly(N-methyl acrylhydroxamic acid; poly(N-acryloyl-α-aminoisobutyryl-N-methylhydroxamic acid); and poly(N-acryloyl-α-aminoisobutyrylhydroxamic acid). Poly(acrylhydroxamic acid) polymers and copolymers thereof are particularly preferred.

The subject interlayer is prepared by reacting a polyvalent metal ion with the polymeric hydroxamic acid to form a cross-linked hydroxamic acid salt barrier layer which is alkali-permeable and water-insoluble. Various photocompatible polyvalent metal moieties can be utilized. Typical metals which are suitable include, calcium, barium, magnesium, manganese, lead, tin, cobalt, nickel, cadmium, zinc, iron, copper, chromium and thorium. Alkaline earth metals are preferred; calcium is particularly preferred.

The salt barrier layer can be formed in the photographic element in any suitable manner. The hydroxamic acid salt may be pre-formed and coated on the element, but, it is generally preferred first to coat a layer of water-soluble polymeric hydroxamic acid on the element. An aqueous solution containing a polyvalent metal ion then can be coated onto the previously applied hydroxamic acid layer to thereby form, in place, an integral barrier layer of a water-insoluble polymeric hydroxamic acid polyvalent metal salt. Aqueous calcium chloride solution is particularly preferred in this procedure.

The amount of metal utilized to form the salt barrier layer can vary widely. Several factors need to be considered in determining the precise amount required in a particular situation. Among considerations are the desired performance properties of the interlayer, the nature of the polyvalent metal, the nature and coverage of the polymeric hydroxamic acid, and the like. A favorable salt barrier has been accomplished using calcium chloride coated over a poly(acrylhydroxamic acid) composition at coverages to provide from about 20 to about 100 percent of the stoichiometric amount of metal needed for complete hydroxamic acid salt formation.

As described above, processing is conducted in the presence of a sequestering agent to complex the metal ion of the interlayer salt barrier in order to render the interlayer permeable to the dye developers, once the exposed silver halide layers have been properly developed. The method of introducing the sequestering agent is not critical. For example, a suitable sequestrant material can be precoated contiguous to the interlayer or can even be introduced as a component of the dye-developer layer. Favorable results have been achieved by introducing the sequestering agent into the negative layers as a component of the alkali processing composition.

Any of a wide variety of sequestering agents capable of complexing the polyvalent metal ions from the hydroxamic acid salt can be used. Typical sequestering agents include amino carboxylic acids, hydroxyalkylamino acids, nitrilocarboxylic acids, sulfhydryl-amino acids, aminosulfonic acids, aminophosphoric acids, hydroxycarboxylic acids, derivatives thereof and the like. For simplicity, the sequestering agents have been defined as free acids; however, the salts, ranging from mono to tetra salts, are intended to be included as well. Specific examples of preferred sequestering agents within the above-recited classes include ethylene diamine tetraacetic acid (EDTA), diamino cyclohexane tetraacetic acid (DCTA) and nitrilo triacetic acid (NTA). EDTA is the particularly preferred sequestrant.

The amount of sequestering agent sufficient for effective interlayer performance is variable, depending on a wide variety of influencing factors. Primary factors are the amount of polyvalent metal ion in the system and the efficiency of the sequestrant itself. Positioning of the sequestrant and its mode of introduction also may be determinant. In general, when introducing the sequestering agent along with the alkali processing composition, concentrations ranging from about 0.05 to about 3.0 percent be weight of the processing composition can be used. Use of a range of about 0.1 to about 0.6 percent has been found to produce favorable results. A concentration range from about 0.2 to about 0.3 percent by weight of the processing composition is particularly preferred.

The invention may be further understood by reference to the figure which is a magnified, diagrammatic, sectional view of a diffusion transfer photographic film unit.

Referring to the figure, element 40 represents a photosensitive, or negative, film component which comprises a support layer 10, a cyan dye developer layer 12, a red-sensitive silver halide emulsion layer 14, an interlayer 16, a magenta dye developer layer 18, a green-sensitive silver halide layer 20, a second interlayer 22 a yellow dye developer layer 24, a blue-sensitive silver halide emulsion layer 26 and a protective overcoat layer 28.

As illustrated in the figure, the multilayer photosensitive element 40 has been selectively exposed to actinic radiation and is depicted in processing relationship with an image-receiving element 42 and a layer of processing composition 30 which has been distributed intermediate negative element 40 and positive element 42. Image-receiving element 42 may be a separate component or may be part of a permanently integral unit with the negative element.

Image-receiving, or positive, element 42 is shown comprising support 38, a polymeric acid neutralizing layer 36, a time modulating or spacer layer 34 and an image-receiving layer 32.

As described in the discussion above, following exposure of negative element 40, aqueous alkaline processing composition 30 is applied to initiate development of the image. As the alkali penetrates the various layers of the negative, it reaches and solubilizes the dye developers in layers 24, 18 and 12. When they are solubilized, the dye developers are capable of moving from their original positions. However, interlayers 16 and 22 are selectively permeable and initially bar passage of the dye developers and restrict their migratory movement to within their associated, complementary silver halide layers. Accordingly, the yellow dye developer of layer 24 is limited to interaction only with the exposed blue-sensitive silver halide of layer 26, the magenta dye developer of layer 18 interacts only with the exposed green-sensitive silver halide of layer 20 and the cyan dye developer of layer 12 interacts only with the exposed red-sensitive silver halide of layer 14. In each silver halide emulsion layer, the exposed silver halide is reduced and developed by its associated dye developer, which, in turn, becomes oxidized leaving it in a substantially immobile state.

The silver halide emulsion layers 14, 20 and 26 of the photosensitive element preferably comprise optically sensitized silver halide, e.g., silver chloride, bromide or iodide or mixed silver halides such as silver iodobromide or chloroiodobromide dispersed in a suitable colloidal binder such as gelatin and such layers may typically be on the order of 0.6 to 6 microns in thickness. It will be appreciated that the silver halide layers may and in fact generally do contain other adjuncts, e.g., chemical sensitizers such as are disclosed in U.S. Pat. Nos. 1,574,944; 1,623,499; 2,410,689; 2,597,856; 2,597,915; 2,487,850; 2,518,698; 2,521,926; etc., as well as other additives performing specific desired functions, e.g., coating aids, hardeners, viscosity-increasing agents, stabilizers, preservatives, ultraviolet absorbers and/or speed-increasing compounds. While the preferred binder for the silver halide is gelatin, others such as albumin, casein, zein, resins such as cellulose derivatives, polyacrylamides, vinyl polymers, etc., may replace the gelatin in whole or in part.

Optical sensitization of the emulsion's silver halide crystals may be accomplished by contact of the emulsion composition with an effective concentration of optical sensitizing dyes selected to impart sensitivity to the silver halide in predetermined regions of the electromagnetic spectrum, e.g., red, green and blue; all according to the traditional procedures of the art, as described in, for example, Hamer, F. A., *The Cyanine Dyes and Related Compounds.*

The respective dye developers may be any of those in the aforementioned U.S. Pat. No. 2,983,606 and numerous other U.S. patents. As examples of U.S. patents detailing specific preferred "metallized" dye developers, mention may also be made of U.S. Pat. No. 3,563,739 and 3,551,406 (magenta dye); U.S. Pat. Nos. 3,597,200 and 3,705,184 (yellow dye); and U.S. Pat. No. 3,482,972 (cyan dye). The dye developers are preferably dispersed in an aqueous alkaline solution permeable polymeric binder, e.g., gelatin or a synthetic film-forming polymer such as disclosed in a multiplicity of prior patents, e.g., U.S. Pat. Nos. 2,992,104; 3,043,692; 3,069,203; 3,061,428; 3,044,873; 3,069,264, etc.

The interlayers serve to prevent interaction between a dye developer and a silver halide emulsion layer containing other than the silver halide by which its diffusion was intended to be controlled. The combination of a dye developer with an exposed silver halide other than its intended associated silver halide would reduce the number of associative sites available in such a silver halide layer to its properly associated dye developer. This would result in severely affected color purity in the transferred dye image in the image-receiving layer. For example, if a diffusion transfer photographic film unit such as that shown in the figure were exposed to red light only, in an ideal situation, upon imbibition of processing composition 30 and development of the red-sensitive silver halide emulsion of layer 14, all the cyan dye developer of layer 12, situated behind the red-sensitive silver halide layer, should interact with the fully-exposed red-sensitive silver halide so as to be controlled to the extent that it is prevented from migrating toward the image-receiving element. Thereby, a red image would be provided in the image-receiving element by the combined total migration of the magenta and yellow dye developers. If, however, the magenta dye developer of layer 18 were able to migrate to red-sensitive silver halide layer 14 to cause development of a portion of the exposed silver halide, the resultant image would no longer be pure red as it should be, but would be desaturated by a lack of a portion of magenta dye and, as well, would be contaminated by an amount of cyan dye that was freed for migration by the interaction of the magenta dye developer with a portion of the cyan-associated exposed silver halide.

The polymeric hydroxamic acid polyvalent metal salt interlayer of the present invention may be employed as one or both of the interlayers 16 and 22 in a diffusion transfer negative element such as shown in the figure. In such a structure, it is preferred that at least the rearmost interlayer comprise the presently invented interlayer composition. Because of its position in the negative relative to the processing composition, the rearmost interlayer 16 situated between the magenta dye developer layer 18 and the red-sensitive emulsion layer 14 is the most critical in regard to timed delay characteristics. Since the cyan dye developer layer 12 is the last to be activated by the processing composition, interlayer 16 must continue to maintain its barrier to yellow and magenta dye developers long enough to enable the cyan dye developer to fully develop all of the exposed silver halide of its associated red-sensitive emulsion.

In the figure both interlayers 16 and 22 are shown comprising a polymeric hydroxamic acid layer, 15 and 21 respectively, including a barrier layer of a polyvalent metal salt of the hydroxamic acid, shown as 17 and 23 respectively. Although shown as an evenly proportioned, integral two layer arrangement, the interlayer actually may comprise various compositional configurations and proportions. For example, a homogeneous layer of the polymeric hydroxamic acid and its polyvalent metal salt may be employed rather than a layered arrangement. The proportional relationship in the interlayer of the hydroxamic acid and the polyvalent metal salt may vary widely; the interlayer may comprise up to 100 percent of the polymeric hydroxamic acid polyvalent metal salt.

Other interlayer materials that may be used comprise alkaline permeable polymeric material such as gelatin and other materials such as those disclosed in U.S. Pat. Nos. 3,421,892; 3,575,701; 3,615,422 and 3,625,685. The interlayers may also contain additional reagents performing specific functions, e.g., various ingredients necessary for development may be contained initially in such layers in lieu of being present initially in the processing composition.

The overcoat layer 28 preferably is a protective layer of gelatin or any suitable alkali permeable material. If desired, it may contain various additives, or it may even comprise an interlayer material which serves as a barrier to premature dye developer migration to the image-receiving layer.

The liquid processing composition 30 introduced for effecting multicolor diffusion transfer processes comprises at least an aqueous solution of an alkaline material, for example, sodium hydroxide, potassium hydroxide, and the like, and preferably possessing a pH in excess of 12, and most preferably includes a viscosity-increasing compound constituting a film-forming material of the type which, when the composition is spread and dried, forms a relatively firm and relatively stable film. The preferred film-forming materials comprise high molecular weight polymers such as polymeric, water-soluble ethers which are inert to an alkaline solution such as, for example, a hydroxyethyl cellulose or sodium carboxymethyl cellulose. Other film-forming materials or thickening agents whose ability to increase viscosity is substantially unaffected if left in solution for a long period of time are also capable of utilization. The film-forming material is preferably contained in the processing composition in such suitable quantities as to impart to the composition a viscosity in excess of 100 cps. at a temperature of approximately 24° C. and preferably in the order of 10,000 cps. to 100,000 cps. at that temperature.

A rupturable container of known description contains the requisite processing composition and is adapted upon application of pressure to release its contents for development of the exposed film unit, e.g., by distributing the processing composition in a substantially uniform layer between a pair of predetermined layers. As shown in the figure, the processing composition is introduced as a layer 30 between overcoat layer 28 of the negative and image-receiving layer 32 of the positive element.

In such diffusion transfer film unit, a sequestering agent may readily be included in the alkali processing composition 30. As the processing composition permeates the negative layers and initiates development, the sequestering agent is introduced to the polymeric hydroxamic acid polyvalent metal salt barrier layer and begins to chelate the polyvalent metal moiety. Once the salt barrier has been transformed to the hydroxamic acid, it becomes water soluble and permits the free migration of the solubilized dye developer compounds.

The yellow dye developer is not impeded in its migration towards the image-receiving layer and proceeds to migrate immediately upon solubilization. After the timed, abrupt breakdown of interlayers 16 and 22, the solubilized magenta and cyan dye developer compounds in the unexposed regions of silver halide also are free to pass through the overlying emulsion and on through the other layers into the image-receiving layer 32 where the dye developers are captured by a polymeric mordant and thereby impart thereto a positive dye transfer image.

As has been noted above, following image formation, the image-receiving element 42 may be separated from the photosensitive element 40 or it may remain permanently integral therewith.

The supports 10 and 38 for the respective elements may be opaque or transparent, as desired, and may comprise any of the materials heretofore employed for such a purpose, e.g., paper base materials, ethylene glycol terephthalic acid, vinyl chloride polymers, polyvinyl acetate, polyamides, polymethacrylic acid methyl and ethyl esters, cellulose derivatives such as cellulose acetate, triacetate, nitrate, propionate, butyrate acetate or acetate butyrate, cross-linked polyvinyl alcohol, etc.

The image-receiving layer 32 generally comprises a dyeable material which is permeable to the alkaline processing composition. The dyeable material may comprise polyvinyl alcohol together with a polyvinyl pyridine polymer such as a poly-4-vinyl pyridine polymer. Such image-receiving layers are further described in U.S. Pat. No. 3,148,061 issued to Howard C. Haas. A preferred image-receiving layer material comprises a graft copolymer of 4-vinylpyridine, vinylbenzyl-trimethylammonium chloride grafted on hydroxyethyl cellulose. Such graft copolymers and their use as image-receiving layers are further described in U.S. Pat. Nos. 3,756,814 and 4,080,346 issued to Stanley F. Bedell.

As disclosed in, for example, U.S. Pat. No. 3,362,819, the polymeric acid neutralizing layer 36 may comprise a nondiffusible acid-reacting reagent adapted to lower the pH from a first (high) pH of the processing composition to a predetermined second (lower) pH. The acid-reacting reagents are preferably polymers which contain acid groups, e.g., carboxylic acid and sulfonic acid groups which are capable of forming salts with alkali metals or with organic bases or potentially acid-yielding groups such as anhydrides or lactones. Preferably the acid polymer contains free carboxyl groups. As examples of useful neutralizing layers, in addition to those disclosed in the aforementioned U.S. Pat. No. 3,362,819, mention may be made of those disclosed in the following U.S. Patents: Bedell U.S. Pat. No. 3,765,885; Sahatjian et al. U.S. Pat. No. 3,819,371; Haas U.S. Pat. No.

3,833,367; Taylor U.S. Pat. No. 3,754,910 and Schlein U.S. Pat. No. 3,756,815.

A spacer or time modulating layer 39 may be and is preferably disposed between the polymeric acid layer and the image-receiving layer in order to control the pH reduction so that it is not premature and hence will not interfere with the development process, e.g., to "time" control the pH reduction. Suitable spacer or "timer" layers for this purpose are described with particularity in U.S. Pat. No. 3,362,819 and in others, including U.S. Pat. Nos. 3,419,389; 3,421,893; 3,433,633; 3,455,686; 3,575,701; 3,785,815 and 3,856,522.

In an alternative embodiment, a polymeric acid neutralizing layer may be positioned in the negative element 40, adjacent support layer 10, separating the support from the innermost dye developer layer 12. Preferably, a spacer or time modulating layer is disposed between the polymeric acid layer and the innermost dye developer layer to prevent premature pH reduction. The polymeric acid layer in the negative may serve either as a replacement or as a supplement for the polymeric acid layer in the image-receiving element. Such configurations are further described, for example, in U.S. Pat. Nos. 3,573,043, issued Mar. 30, 1970 and 3,362,821, issued Jan. 9, 1968, both to E. H. Land.

The following examples are provided to further illustrate the invention.

PREPARATION OF POLYMERIC HYDROXAMIC ACID

EXAMPLE I

To a stirred anhydrous solution of hydroxylamine hydrochloride in methanol [42.12 g (0.606 mole) $NH_2OH.HCl$ in 100 ml $CH_3OH$] was added 138 ml of sodium methoxide solution [25% $NaOCH_3$ solution (0.606 mole)] over a period of 30 minutes, while maintaining the stirred mixture under a nitrogen atmosphere at a temperature of 10° C. After adding the sodium methoxide, the reaction mixture was continued to be stirred for an additional 45 minutes, at 10°–22° C., under nitrogen. The mixture was then filtered and the filtrate was added to a power stirred solution of poly(methylacrylate) [20.0 g (0.232 equiv.)] in toluene [400 ml (dry)] maintained on an ice bath under a nitrogen atmosphere. [The poly(methylacrylate) was obtained from Polysciences, Inc. under Cat. No. 2259.] After addition, the reaction mixture was stirred at ambient temperature for 20 hours and then returned to an ice bath. To the chilled mixture was added 60 ml of sodium methoxide [25% $NaOCH_3$ solution (0.26 mole)] over a period of 1 hour. The resulting reaction mixture was stirred for an additional 4 hours under nitrogen at ambient temperature and then held unstirred under nitrogen at ambient temperature for 48 hours. The reaction mixture was then chilled on ice and 35 ml of glacial acetic acid was added over 5 minutes. This mixture was stirred for 1 hour and then vacuum filtered. The collected polymer was washed with 300 ml. of methanol 6 times and dried at reduced pressure, yielding 21.5 g of a white, solid product.

The product was identified as:

Poly(acrylhydroxamic acid)-co-(acrylic acid)-co-(methyl acrylate)

-continued

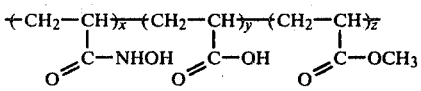

The copolymer product was analyzed by $C^{13}$ NMR to be 84 to 89 mole percent hydroxamic acid; 8 to 12 percent acrylic acid; and 3 to 5 percent methylacrylate.

EXAMPLE II

To a stirred, anhydrous solution of hydroxylamine hydrochloride in dimethylformamide [12.41 g $NH_2OH.HCl$ (179 meq) in 100 ml DMF] was added 18.06 g of triethylamine (179 meq) over a 15 minute period. The reaction mixture was stirred for an additional 15 minutes at 22° C. and then filtered. The filtrate was added to 10.0 g (59.5 meq) of poly(acryloyl N-hydroxysuccinimide ester) and stirred 24 hours 22° C. [The poly(acryloyl N-hydroxy-succinimide ester was made by polymerizing an anhydrous solution of N-acryloxysuccinimide (15.0 g in 60 g DMF) in the presence of 30 mg azobisisobutyronitrile (AIBN) free radical initiator, at 60° C. for 24 hours.] The reaction product was precipitated into 600 ml of methanol and then the collected solid was resuspended and collected 3 times in 200 ml of methanol. The final collected product was dried at reduced pressure to yield 4.80 g of an off white solid identified as: poly(acrylhydroxamic acid)-co-(acrylic acid),

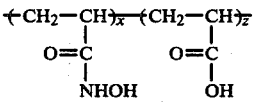

The copolymer product was analyzed by $C^{13}$ NMR to contain 82 to 86 mole percent hydroxamic acid, and 13 to 17 percent acrylic acid.

EXAMPLE III

To a stirred, anhydrous solution of hydroxylamine hydrochloride in dimethylformamide [12.41 g $NH_2OH.HCl$ (179 meq) in 100 ml DMF] was added 18.06 g of triethylamine (179 meq) over a 15 minute period. The reaction mixture was stirred for an additional 15 minutes at 22° C. and then filtered. The filtrate was added to 10.0 g (59.5 meq) of poly(acryloyl N-hydroxysuccinimide ester) and stirred for 24 hours at 22° C. [The polyacryloyl N-hydroxysuccinimide was prepared by polymerizing N-acryloxysuccinimide (15.0 g in 60 g dry DMF) in the presence of 3.0 mg azobisisobutyronitrile (AIBN), free radical initiator, at 63° C. for 24 hours.] The resulting reaction product was precipitated into 600 ml of methanol and then the collected precipitate was resuspended and collected 3 times in 200 ml of methanol. The final collected product was dried at reduced pressure to yield 4.82 g of an off-white solid identified as: poly(acrylhydroxamic acid)-co-(acrylic acid),

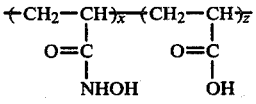

The copolymer was analyzed by $C^{13}$ NMR to contain 84 to 90 mole percent hydroxamic acid, and 8 to 14 percent acrylic acid.

EXAMPLE IV

In order to demonstrate the effectiveness of interlayers prepared in accordance with the present invention, monochrome test structures were assembled and evaluated. The test structures were sandwich arrangements of a transparent support, a layer of cyan dye developer, the test interlayer material and a second transparent element, with provision for the introduction of an alkaline processing composition between the interlayer and second transparent element.

The monochrome test structures were made by first coating a transparent support with a layer comprising: 25 mg/ft$^2$ (269 mg/m$^2$) of a cyan dye developer, 40 mg/ft$^2$ (430 mg/m$^2$) gelatin and 1.5 mg/ft$^2$ (16.1 mg/m$^2$) of succinaldehyde, using a conventional loop coater. The cyan dye developer can be represented by the following formula:

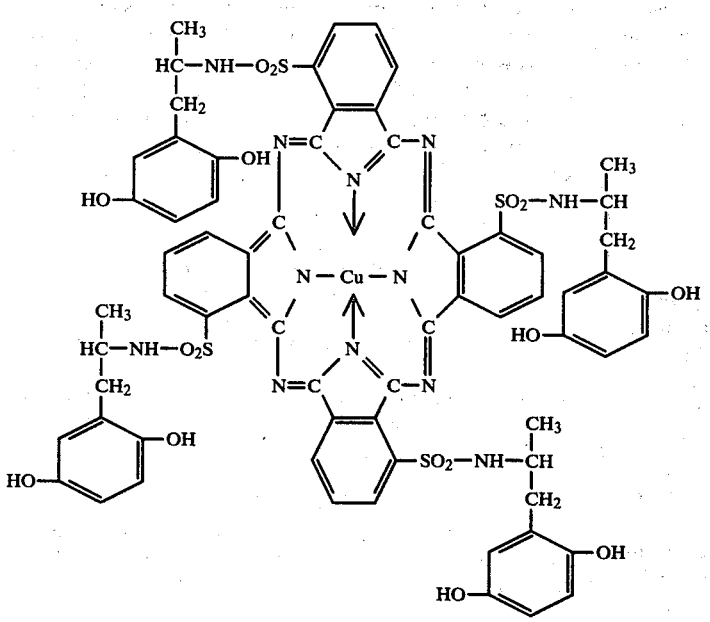

Over this layer was successively coated varying coverages of polymeric hydroxamic acid compositions and polyvalent metal solution to form the salt interlayer of the present invention. A conventional loop coater was employed for both coatings.

A clear transparent polyester film member then was superposed over the test elements to form a sandwich structure, and an alkaline processing composition was introduced between the interlayer and the polyester film member at a gap of 71 μm. The processing composition comprised the following components:

| | |
|---|---|
| Potassium hydroxide (45% aqueous solution) | 391 g |
| 6-methyl uracil | 32 g |
| Bis-2-methylbenzimidizole sulfide | 0.6 g |
| 6-benzylaminopurine | 10 g |
| 1-methylimidizole | 70 cc |
| Titanium dioxide | 1440 g |
| N-benzyl α-picolinium bromide (50% aqueous solution) | 98 g |
| Carboxymethyl hydroxyethyl cellulose | 68 g |

-continued

| | |
|---|---|
| Water | 1700 g |

The evaluation of the subject interlayers was conducted using a backside dye diffusion analysis technique. This analysis involved processing each test structure and monitoring the optical reflection density to red light of the processed sample, viewed through the backside of the test structure (i.e., viewed through the transparent support on the cyan dye side of the structure). The optical density as a function of time was continuously read using a MacBeth Quanta-Log densitometer equipped with a Hewlett Packard 17505A strip-chart recorder. In this manner, the dye developer is monitored as it is dissolved by the alkali of the processing composition and diffuses through the interlayer. The optical density read includes contributions from the dye materials in the dye developer layer and any dye material in the interlayer, but the titanium dioxide in the processing composition masks the dye material that has diffused through the interlayer.

The parameters that were measured for each test structure included:

$T_2$—the time when alkali-dissolved dye developer material first began to diffuse through the interlayer and into the processing composition. This time measurement is commonly called the "delay time" and is a measure of the effectiveness of the interlayer as an initial timed barrier to the diffusion of dye developer.

Slope—the percentage of the total density change at a given time. This is a determination of the rate of dye developer material transfer through the interlayer and serves as a measure of the abruptness and completeness of the interlayer breakdown after the initial, timed barrier period.

Table A, below, shows the delay time/slope results from monochrome testing structures with interlayers comprising polymeric hydroxamic acid polyvalent metal salts formulated from the polymeric hydroxamic acid composition prepared in Example I. Calcium chloride was used as the polyvalent metal source, and the tetra-sodium salt of ethylenediaminetetraacetic acid was used as the sequestering agent, introduced in the processing composition. Various test structures were prepared, having polymeric hydroxamic acid coatings at coverages of 25, 50, 100 and 150 mg/ft$^2$ (269, 538, 1076 and 1614 mg/m$^2$). The varying coverages of calcium chloride are listed; this amount determines the percentage of hydroxamic acid converted to the metal salt (e.g., 19 mg/ft$^2$ (204 mg/m$^2$) CaCl is the stoichiometric equivalent for 25 mg/ft$^2$ (269 mg/m$^2$) of the polymeric hydroxamic acid). The amount of sequestering agent (EDTA) also appears in the table as the weight percent of processing composition (e.g., 1.08% EDTA in the processing composition is the stoichiometric equivalent for 204 mg/m$^2$ CaCl). While desirable dye developer diffusion delay times and rate of transfer slopes may differ with varying dye diffusion photographic systems, the interlayer performance properties reported in the table generally indicate favorable hold-release capability.

TABLE A

| | | 269 | 538 (mg/m$^2$) | 1076 | 1614 |
|---|---|---|---|---|---|
| 0 | % | $T_2$(min)/ | | | |
| Mg/ft$^2$ | EDTA | Slope(%) | | | |
| (Mg/m$^2$) | 0 | 0/3646 | 0/1073 | 0/1078 | 0/579 |
| | 0 | 1.6/49 | 0.7/92 | 0/2100 | 0/551 |
| 10 | .14 | 0.9/85 | 0.52/362 | | |
| (108) | .27 | 0.55/93 | 0.37/688 | | |
| | .54 | 0.1/581 | 0.1/500 | | |
| Coverage | 0 | 00/0 | 00/0 | 0.6/292 | 0.1/84 |
| 19 | .14 | | | | 1.1/83 |
| (204) | .27 | 00/0 | 1.1/40 | 0.1/258 | 0/422 |
| | .54 | 00/30 | 0.3/331 | | |
| $CaCl_2$ | 1.08 | 0.1/1172 | | | |
| | 0 | 00/0 | 0.8/30 | 1.3/61 | 0:6/53 |
| 37 | .54 | 00/0 | | | |
| (398) | 1.08 | 00/0 | 0.1/641 | 0.4/240 | 0.5/188 |
| | 1.62 | 0.2/216 | 0.05/750 | 0.2/320 | 0.2/336 |
| | 2.16 | | | 0.1/500 | |
| | | 25 | 50 (mg/ft$^2$) | 100 | 150 |
| | Polymeric Hydroxamic Acid Coverage | | | | |

EXAMPLES V and VI

Using the same general procedure as outlined in Example IV, above, monochrome test structures were prepared and tested, employing, however, interlayers comprising polymeric hydroxamic acid compositions prepared in Examples II and III, respectively. In each of the test structures prepared, coatings of the polymeric hydroxamic acid composition were applied at a coverage of 100 mg/ft$^2$ (1076 mg/m$^2$); $CaCl_2$, which was used as the polyvalent metal source, was applied at a coverage of 40 mg/ft$^2$ (430 mg/m$^2$). The amount of tetrasodium EDTA introduced with the alkaline processing composition was varied; 0, 0.54, 1.08 and 1.62 percent by weight of the total processing composition. The test results are listed below in Table B:

TABLE B

| | Polymeric Hydroxamic Acid | | Polyvalent Metal ($CaCl_2$) | Sequestrant (EDTA) | | |
|---|---|---|---|---|---|---|
| | Composition | Coverage (mg/ft$^2$) (mg/m$^2$) | Coverage (mg/ft$^2$) (mg/m$^2$) | Weight % Processing Composition | Delay Time $T_2$ (Minutes) | Slope Rate of Density Change (percent) |
| Example V | From Ex II | 100 (1076) | 40 (430) | 0 | .25 | 249 |
| | | | | 0.54 | .07 | 246 |
| | | | | 1.08 | .05 | 333 |
| | | | | 1.62 | .01 | 550 |
| Example VI | From Ex III | 100 (1076) | 40 (430) | 0 | .14 | 107 |
| | | | | 0.54 | .12 | 112 |
| | | | | 1.08 | .05 | 276 |
| | | | | 1.62 | .07 | 286 |

EXAMPLE VII

A control photosensitive element was prepared by coating, in succession, on a polyethylene glycol terephthalate base, the following layers:

(1) a layer of a gelatin dispersion of a cyan dye developer, 2-phenylbenzimidazole, and 4'-methylphenylhydroquinone at a coverage of about 747 mg/m$^2$ of dye, 270 mg/m$^2$ of 2-phenylbenzimidazole, 67.8 mg/m$^2$ of 4'-methylphenylhydroquinone and 1532 mg/m$^2$ of gelatin;

(2) a red-sensitive gelatino-silver iodobromide emulsion layer consisting of 1.8$\mu$ average mean diameter grains at a coverage of about 1280 mg/m$^2$ of silver and about 768 mg/m$^2$ of gelatin;

(3) an inert spacer layer of a polymethylmethacrylate latex having an average particle size of about 0.110$\mu$ at a coverage of about 1900 mg/m$^2$ polymethylmethacrylate and about 100 mg/m$^2$ of polyacrylamide;

(4) an interlayer comprising about 2504 mg/m$^2$ of 60.6/29/6.3/3.7/0.4 pentapolymer of butylacrylate, diacetone acrylamide, styrene, methacrylic acid and acrylic acid and about 78 mg/m$^2$ of polyacrylamide;

(5) a layer of a gelatin dispersion of a magenta dye developer and benzimidazole at a coverage of about 646 mg/m$^2$ of dye, 230 mg/m$^2$ of 2-phenylbenzimidazole and 448 mg/m$^2$ of gelatin;

(6) a green sensitive gelatino-silver iodobromide emulsion layer consisting of 1.05$\mu$ average mean diameter grains at a coverage of about 420 mg/m$^2$ of silver and about 185 mg/m$^2$ of gelatin;

(7) an inert spacer layer of a polymethylmethacrylate latex having an average particle size of about 0.110$\mu$ at a coverage of about 684 mg/m$^2$ polymethylmethacrylate and about 36 mg/m$^2$ polyacrylamide;

(8) a green sensitive gelatino-silver iodobromide emulsion layer consisting of 1.8$\mu$ average mean diameter grains at a coverage of about 790 mg/m$^2$ of silver and about 379 mg/m$^2$ of gelatin;

(9) a spacer layer comprising gelatin at a coverage of about 215 mg/m$^2$ and 2-hydroxy-3-amino-4-n-undecyl (2,3-cyclopentenone) at a coverage of about 215 mg/m$^2$;

(10) an interlayer comprising about 1366 mg/m$^2$ of 60.6/29/6.3/3.7/0.4 pentapolymer of butylacrylate, diacetone acrylamide, styrene, methacrylic acid and acrylic acid and about 87 mg/m$^2$ of polyacrylamide and about 70.5 mg/m$^2$ of succindialdehyde;

(11) a layer of a gelatin dispersion of a yellow dye developer and 2-phenylbenzimidazole at a coverage of about 968 mg/m$^2$ of dye, 207 mg/m$^2$ of 2-phenylbenzimidazole and 452 mg/m$^2$ of gelatin;

(12) a blue sensitive gelatino-silver iodobromide emulsion layer consisting of 1.8$\mu$ average mean diameter grains at a coverage of about 1280 mg/m$^2$ of silver and about 776 mg/m$^2$ of gelatin, about 306 mg/m$^2$ of 4'-methylphenylhydroquinone, and about 517 mg/m$^2$ of diethyldodecanamide;

(13) an overcoat layer at a coverage of about 21 mg/m$^2$ of carbon black and about 484 mg/m$^2$ of gelatin.

The three dye developers used were as follows:

cyan:

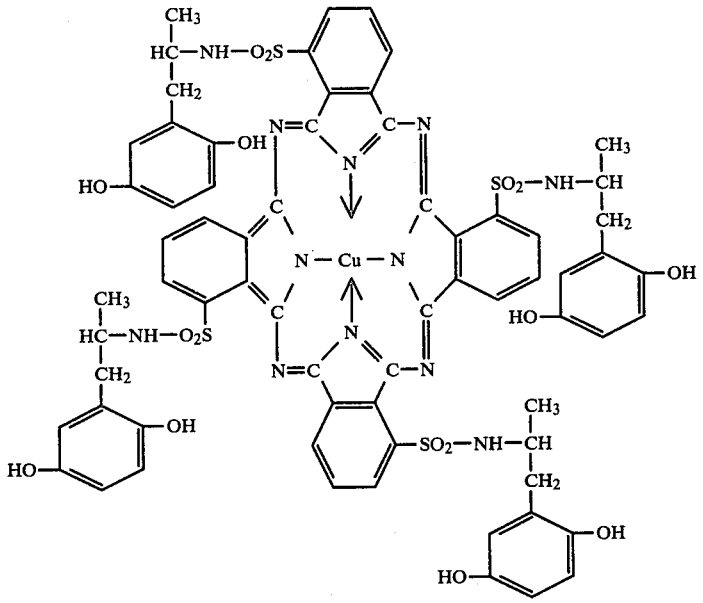

magenta:

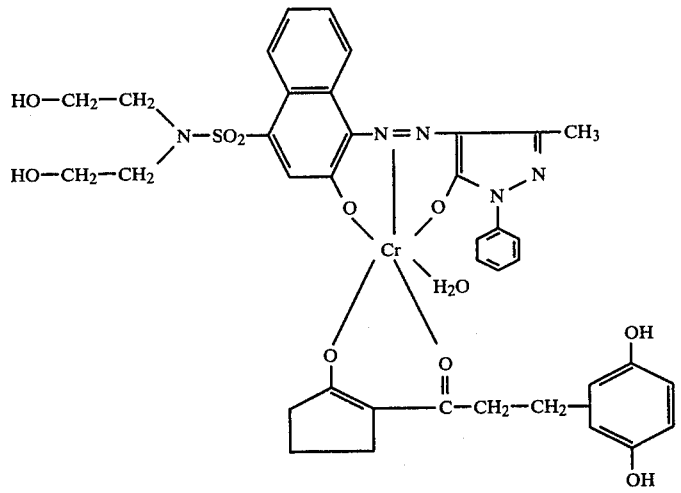

yellow:

-continued

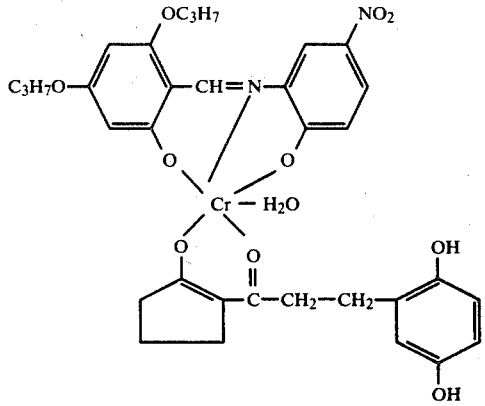

An image-receiving element was prepared by coating, in succession, on a transparent 4 mil polyester film base the following layers:

(1) a polymeric acid layer comprising the partial butyl ester of polyethylene/maleic anhydride copolymer at a coverage of about 2500 mg/ft$^2$;

(2) a timing layer comprising a graft copolymer of diacetone acrylamide (180 parts by weight), acrylamide (12 parts by weight), $\beta$-cyanoethylacrylate (12 parts by weight) and 2-acrylamido-2-methylpropane sulfonic acid (1 part by weight) on 22 parts by weight of a polyvinyl alcohol backbone at a coverage of about 9700 mg/m$^2$;

(3) a polymeric image-receiving layer comprising a graft copolymer of 4-vinylpyridine (2.2 parts by weight) and vinyl benzyltrimethyl ammonium chloride (1.0 part by weight) on hydroxyethylcellulose (2.2 parts by weight) at a coverage of about 3250 mg/m$^2$ and including about 110 mg/m$^2$ butanediol diglycidyl ether as a crosslinker.

Test photosensitive elements were prepared which differed from the above-described control photosensitive element in that layer (4), instead of comprising the described pentapolymer and polyacrylamide, comprised a polymeric hydroxamic acid polyvalent metal salt interlayer according to the present invention. The interlayer was formed first by coating a polymeric hydroxamic acid, poly (acrylhydroxamic acid)-co-(methyl acrylate), the product of Example I, at a coverage of about 1500 mg/m$^2$. The hydroxamic acid metal salt was formed by loopcoating a stoichiometric amount (1162 mg/m$^2$) of a polyvalent metal salt solution ($CaCl_2$) over the completed negative structure.

The test and control photosensitive elements were exposed through a multicolor strip wedge target which included a graduated neutral density wedge. Following photoexposure, the respective photosensitive elements were each superimposed with one of the above-described image-receiving elements in a face-to-face relationship with their respective supports outermost. A rupturable container retaining an aqueous alkaline processing composition was fixedly mounted transverse the leading edge of the respective superposed elements to provide test and control film units. These film units were passed through a pair of pressure rollers set at a gap of 0.076 mm effecting rupture of the containers and uniform distribution of the aqueous processing composition between the elements of the film units. Processing was conducted at room temperature of about 24° C.

The control and test photosensitive elements were processed using an aqueous alkaline processing composition comprising:

| | |
|---|---|
| Titanium dioxide | 1440 g |
| Carboxymethyl hydroxyethyl cellulose | 68 g |
| Potassium hydroxide (45% solution) | 444 g |
| 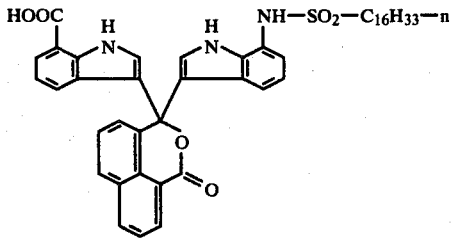 | 12 g |
| 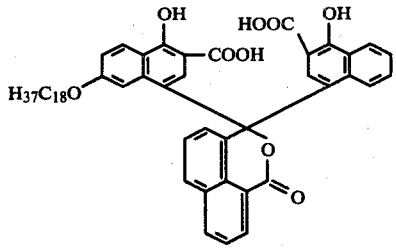 | 60 g |
| 6-methyl uracil | 32 g |
| 6-benzylaminopurine | 10 g |
| Bis-2-methylbenzimidizole sulfide | 0.6 g |
| 1-methylimidizole | 70 cc |
| N-benzyl $\alpha$-picolinium bromide | 98 g |
| Water | 1700 g |

To show the effect of sequestrant on the test interlayer, a series of processing compositions also was used which differed from the above-described processing composition in that they included varying amounts of sequestering agent (EDTA) to complex the metal ion of the test interlayer in order to render the interlayer permeable to the dye developers.

The resulting diffusion transfer photographic images were evaluated to determine red Dmax (density to red light in an unexposed area), as a measure of the amount of cyan dye transferred, and magenta "drop-back" (the difference between the density to green light in the toe of the red column and the density to green light in an unexposed area), as a measure of the amount of magenta dye that did not transfer due to red light exposure.

These two evaluations serve as an indication of the performance of the test interlayer which is positioned in the negative separating the magenta dye control layers from the cyan dye control layers. The ability of the subject interlayer to function as a barrier between the magenta and cyan dye control layers so as to prevent magenta dye control by red light exposure is evidenced by a minimized magenta "drop-back." Both the control and the test interlayers provided favorable response with regard to magenta "drop-back" characteristics. Increased red Dmax with increasing sequestrant (EDTA) concentration demonstrates that the invented interlayer is rendered permeable by the EDTA and allows ready transfer of cyan dye from the negative to the image-receiving element.

The sensitometric results are outlined in Table A below:

| | Red Dmax | MAGENTA "Drop-Back" |
|---|---|---|
| TEST INTERLAYER | | |
| Sequestrant in Processing Composition (Equivalents EDTA/ $Ca^{+2}$) | | |
| 0 | .48 | −.13 |
| 0.3 | .47 | −.12 |
| 0.6 | .48 | −.14 |
| 0.9 | .53 | −.14 |
| 1.1 | 1.49 | −.14 |
| 1.2 | 1.67 | −.14 |
| CONTROL | | |
| 0 | 1.43 | −.11 |
| 0.3 | 1.43 | −.12 |
| 0.6 | 1.44 | −.10 |
| 0.9 | 1.42 | −.11 |
| 1.1 | 1.43 | −.11 |
| 1.2 | 1.44 | −.12 |

Although the invention has been particularly described with reference to preferred embodiments thereof, it will be understood that various alterations may be made therein without departing from the spirit and scope of the invention. For convenience, the more specific description of the invention was presented by use of the preferred diffusion transfer color processes and film units, but the invention was not intended to be limited to the specific structures shown and described. The present invention is applicable to a wide variety of color diffusion transfer processes and the arrangement and order of the individual layers of the film unit used in such processes may vary in many ways as is known in the art.

What is claimed is:

1. A photosensitive element for use in diffusion transfer photographic processes which comprises:

at least two selectively sensitized silver halide layers having image-dye forming materials associated herewith; and an interlayer separating said silver halide layers comprising an alkali-permeable polymeric hydroxamic acid polyvalent metal salt, said interlayer comprising said alkali-permeable polymeric hydroxamic acid polyvalent metal salt serving as a barrier to migration of alkali-solubilized image-dye forming material and being rendered permeable to said alkali-solubilized image-dye forming material subsequent to contact of said interlayer with an organic alkali-soluble sequestering agent for the polyvalent metal of the polymeric hydroxamic acid salt.

2. The photosensitive element of claim 1 wherein said polymeric hydroxamic acid polyvalent metal salt is based on a polymeric composition comprising a polyvinyl hydroxamic acid.

3. The photosensitive element of claim 2 wherein said polyvinyl hydroxamic acid is poly(acrylhydroxamic acid).

4. The photosensitive element of claim 1 wherein said polymeric hydroxamic acid polyvalent metal salt is an alkaline earth metal salt.

5. The photosensitive element of claim 4 wherein the alkaline earth metal is calcium.

6. The photosensitive element of claim 5 wherein said interlayer comprises a calcium salt of poly(acrylhydroxamic acid).

7. The photosensitive element of claim 6 wherein said sequestering agent is selected from the group consisting of ethylene diamine tetraacetic acid, diamine cyclohexane tetraacetic acid, and nitrilo triacetic acid.

8. The photosensitive element of claim 6 wherein said sequestering agent is ethylene diamine tetraacetic acid.

9. The photosensitive element of claim 1 for use in diffusion transfer photographic processes which comprises:

a support layer;

a red-sensitive silver halide layer having associated therewith a cyan image-dye forming material;

a green-sensitive silver halide layer having associated therewith a magenta image-dye forming material;

a blue-sensitive silver halide layer having associated therewith a yellow image-dye forming material; and, two interlayers separating said silver halide layers, at least one of said interlayers comprising an alkali-permeable layer of poly(acrylhydroxamic acid) calcium salt which serves as a barrier to migration of alkali-solubilized image-dye dorming material, said barrier rendered permeable to said alkali-solubilized image-dye forming material subsequent to contact of said barrier with an organic alkali-soluble sequestering agent for the calcium ion of the poly(acrylhydroxamic acid) salt.

10. The photosensitive element of claim 9 wherein said image-dye forming material is a dye developer.

11. The photosensitive element of claim 9 wherein said sequestering agent is selected from the group consisting of ethylene diamine tetraacetic acid, diamino cyclohexane tetraacetic acid and nitrilo triacetic acid.

12. The photosensitive element of claim 11 wherein said sequestering agent is ethylene diamine tetraacetic acid.

13. The photosensitive element of claim 9 wherein said sequestering agent is introduced as a component of an alkaline processing composition.

14. The photosensitive element of claim 9 wherein said poly(acrylhydroxamic acid) calcium salt interlayer comprises a layer of poly(acrylhydroxamic acid) composition including a cross-linked hydroxamic acid calcium salt barrier layer formed by contacting said layer of poly(acrylhydroxamic acid) with a calcium chloride solution.

15. The photosensitive element of claim 14 wherein said interlayer comprises a layer of poly(acrylhydroxamic acid) composition wherein about 20 to about 100 percent of the hydroxamic acid groups have been converted to calcium salts to form an integral alkali-permeable barrier layer.

16. The photosensitive element of claim 14 wherein said poly(acrylhydroxamic acid) composition comprises about 50 to about 100 mole percent polymeric hydroxamic acid.

17. The photosensitive element of claim 16 wherein said poly(acrylhydroxamic acid) composition comprises about 80 to 90 percent polymeric hydroxamic acid.

18. The photosensitive element of claim 17 wherein said poly(acrylhydroxamic acid) composition comprises poly (acrylhydroxamic acid)—(acrylic acid)—(-methylacrylate) copolymer.

19. The photosensitive element of claim 9 wherein both of said interlayers comprise an alkali-permeable layer of poly(acrylhydroxamic acid) calcium salt.

20. The photosensitive element of claim 18 comprising at least one interlayer comprising an alkali-permeable layer of poly(acrylhydroxamic acid) calcium salt which serves as a barrier to migration of alkali-solubilized dye developer material, said barrier rendered permeable to acid alkali-solubilized dye developer material subsequent to contact of said barrier with an alkaline processing composition containing an ethylene diamine tetraacetic acid sequestering agent for the calcium ion on the poly(acrylhydroxamic acid) salt.

* * * * *